US006061033A

United States Patent [19]

Hulderman et al.

[11] Patent Number: 6,061,033

[45] Date of Patent: May 9, 2000

[54] MAGNIFIED BEAM WAVEGUIDE ANTENNA SYSTEM FOR LOW GAIN FEEDS

[75] Inventors: Garry N. Hulderman, Riverside; Kenneth W. Brown, Yucaipa, both of Calif.

[73] Assignee: Raytheon Company, Lexington, Mass.

[21] Appl. No.: 08/965,092

[22] Filed: Nov. 6, 1997

[51] Int. Cl.[7] ..... H01Q 19/14

[52] U.S. Cl. ..... 343/781 CA; 343/761; 343/781 P

[58] Field of Search ..... 343/781 CA, 761, 343/781 P, 781 R, 839, 779, 837; H01Q 19/14

[56] References Cited

U.S. PATENT DOCUMENTS

| | | | |
|---|---|---|---|
| 3,845,483 | 10/1974 | Soma et al. | 343/761 |
| 4,186,402 | 1/1980 | Mizusawa et al. | 343/781 CA |
| 4,525,719 | 6/1985 | Sato et al. | 343/781 CA |
| 5,673,057 | 9/1997 | Toland et al. | 343/781 CA |

*Primary Examiner*—Hoanganh Le
*Attorney, Agent, or Firm*—David W. Collins; Andrew J. Rudd; Glenn H. Lenzen, Jr.

[57] ABSTRACT

An antenna system includes a beam source of a microwave wave beam, a gimbaled antenna, and a waveguide including a mirror system that directs the microwave wave beam from the beam source to the antenna. The mirror system is formed of a series of mirrors operable to reflect the microwave wave beam and includes a first paraboloid mirror positioned to receive the microwave wave beam from the beam source, a first planar mirror positioned to receive the microwave wave beam from the first paraboloid mirror, a second paraboloid mirror positioned to receive the microwave wave beam from the first planar mirror, and a second planar mirror lying on the system azimuth axis and positioned to receive the microwave wave beam from the second paraboloid mirror. The first planar mirror may be controllably tilted to finely steer the aim of the microwave wave beam to the antenna.

23 Claims, 2 Drawing Sheets

MAGNIFIED BEAM WAVEGUIDE ANTENNA SYSTEM FOR LOW GAIN FEEDS

BACKGROUND OF THE INVENTION

This invention relates to a beam waveguide for coupling energy from a stationary beam source into a rotatable-reflector antenna.

In one type of directional antenna system, a signal to be transmitted is generated from a source, directed against a front face of a reflector, and projected through free space by reflection from the reflector. The reflector is typically parabolic in shape, so that the signal directed against it from its focus is projected as a parallel beam. Variations in this basic approach, such as the Cassegrain antenna employing a main reflector and a subreflector, have been developed.

The aiming of the signal emanating from the antenna is accomplished by pointing the reflector in the desired direction. One approach to pointing the antenna is to mount the antenna on a rotational mechanism. The rotational mechanism may be of any type, but one common structure uses a gimbal that permits the antenna reflector to be pointed in any direction of a hemisphere.

Two important problems in the design of an antenna having the gimbaled antenna reflector are coupling the signal from the signal source to the reflector and minimizing the signal loss between the signal source and the reflector. In one straightforward approach, the source is affixed to the antenna reflector and must be supported and moved by the gimbal mechanism. This approach is not desirable for most antenna systems due to the weight and bulk of the source, which in turn require that the gimbaling mechanism be larger and heavier than desirable.

Responsive to this problem, antenna systems have been developed wherein the transmitting tube is fixed, and a waveguide extends from the transmitting tube to the feed horn. The feedhorn is mounted to the antenna reflector and is therefore movable with the reflector. The waveguide has one or more rotary joints to allow the feed horn to rotatably move with the antenna reflector. This approach is operable, but signal losses in the rotary joints, especially at millimeter wave frequencies, are high.

In a further improvement, a beam waveguide using reflective elements has been developed and is in use with deep-space radio telescopes. This approach will be discussed more fully subsequently, but for most applications it requires that a high-gain feed be used. If a lower gain feed is used with magnification of the source, the feed pattern is corrupted.

There is a need for a beam waveguide and antenna system that can utilize a low-gain feed without corrupting the feed pattern purity. The present invention fulfills this need, and further provides related advantages.

SUMMARY OF THE INVENTION

The present invention provides an antenna system for generating and directionally transmitting signals. Only the reflector is mounted to a mechanical gimbal, reducing the supported weight to the lowest possible value and thence reducing the requirement for the size and weight of the gimbal. The transmission of the beam from the source to the antenna is accomplished in a nearly lossless fashion, both in terms of reflective losses and mechanical losses. The present approach allows an effective magnification of the feed horn of the source without corrupting the symmetry and polarization purity of the beam, so that a smaller feed horn may be used than would otherwise be the case. The use of smaller feed horns in turn allows the implementation of multiple feed horns for monopulse or scanned antennas, and the spillover of beam energy when multiple feed horns are used is minimized.

In accordance with the invention, an antenna system comprises a source of a beam of radiation that lies on and is directed parallel to a system axis, an antenna, a gimbal support for the antenna, and a mirror feed system operable to direct the beam from the source to the antenna. The antenna preferably comprises a Cassegrain main reflector having a focal point lying on an antenna axis, and a Cassegrain subreflector lying on the antenna axis at a location between the Cassegrain main reflector and the focal point of the Cassegrain main reflector, with the Cassegrain subreflector having a virtual focal point lying on the antenna axis. The source and feed system may also be used with other types of antennas, such as a prime focus paraboloid, an offset paraboloid, or a Gregorian system. The gimbal support is operable to rotate the antenna about the system axis and about an elevational axis lying perpendicular to the system axis. The mirror system is made of mirrors operable to reflect the beam. The mirror system includes a first paraboloid mirror lying on the system axis and positioned to receive the beam from the source, a first planar mirror lying off the system axis and positioned to receive the beam from the first paraboloid mirror, a second paraboloid mirror lying off the system axis and positioned to receive the beam from the first planar mirror, and a second planar mirror lying on the system axis and positioned to receive the beam from the second paraboloid mirror. The second planar mirror reflects the beam coincident with the antenna axis and toward the Cassegrain subreflector through an aperture in the Cassegrain main reflector. The first paraboloid mirror and the second paraboloid mirror cooperate to focus the beam to the virtual focal point of the antenna.

The approach of the invention is preferably used with microwave signals having a frequency of from about 1 GHz (gigahertz) to about 200 GHZ, and most preferably with the millimeter wave portion of the microwave range having a frequency of from about 70 GHz to about 110 GHz. The microwave wave signal is supplied from a source, which may be one, but which is preferably at least two, and most preferably an array of five, monopulse feed horns.

To direct the beam from the source to the first flat mirror located off the system axis, the first paraboloid mirror has its axis of symmetry oriented at an optimum angle of about 2 arctan (1/M), where M is the desired feed magnification. This optimum angle ensures that the symmetry and polarization purity of the feed will be maintained. The focal length $F_1$ of the first paraboloid mirror may be different from the focal length $F_2$ of the second paraboloid mirror, which magnifies the feed horn source at the virtual focal point so that a smaller actual feed horn may be used. The relation between the focal lengths is $F_2=F_1\ (M^2+1)/2M$, where M is 1 if no magnification is used. The first planar mirror may be tilted about perpendicular axes lying in the plane of the mirror to provide a fine antenna beam steering capability for fine adjustments in the direction of the beam emanating from the antenna.

The present invention provides an important advance in the art of steerable antennas, particularly for use in microwave and millimeter wave applications. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
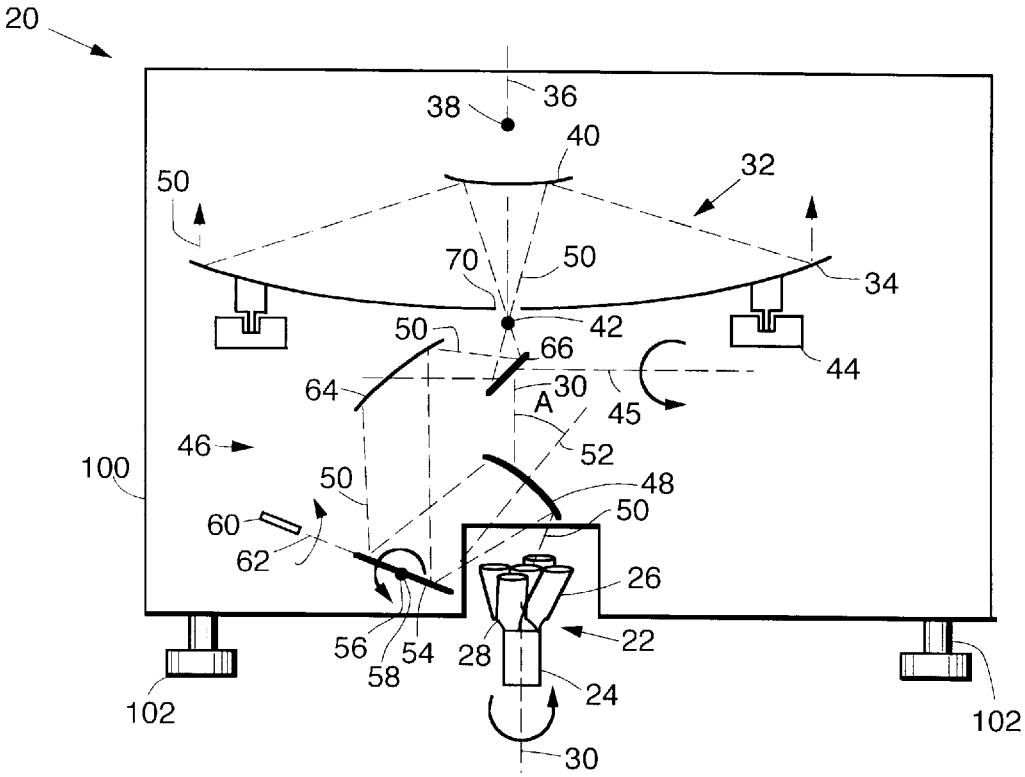
FIG. 1 is a schematic drawing of an antenna system using a beam waveguide according to the invention.

FIG. 1 depicts an antenna system 20 according to the present invention. The antenna system 20 includes a source 22 of a beam of radiation. The source 22 is preferably a microwave source operating in the range of from about 1 GHz to about 200 GHz, and is most preferably a millimeter wave source operating in the range of from about 70 GHz to about 110 GHz. The microwave source 22 includes a transmitter tube/electronics assembly 24 and a waveguide extending to a microwave feed horn 26. In some cases, the source 22 may include more than one microwave feed horn 26, such as the illustrated five feed horns, with a waveguide 28 supplying each feed horn.

The source 22 lies on a system azimuth axis 30, and directs its energy generally parallel to the system azimuth axis 30. The system azimuth axis 30 provides a first reference axis for discussing the relationship of the components of the antenna system 20. The components of the system falling within a box 100 are supported on a rotational gimbal support 102 and rotated about the system azimuth axis 30 by the rotation of the rotational gimbal support 102, which typically includes a track that guides the rotation. The source 22 does not rotate about the system azimuth axis 30 in this preferred embodiment in order to reduce the weight and bulk that must be rotated, although the source 22 could be mounted to rotate about the system azimuth axis 30 if desired.

The antenna system 20 further includes an antenna 32, which may be of any operable type but is typically of the Cassegrain type. The Cassegrain antenna includes a paraboloid main reflector 34 centered on an antenna axis 36 and having a paraboloid focal point 38 lying on the antenna axis 36. The Cassegrain antenna further includes a hyperboloid subreflector 40 in generally facing relation to the main reflector 34 and centered on the antenna axis 36. The subreflector 40 is positioned between the main reflector 34 and the paraboloid focal point 38. The subreflector 40 defines a virtual focal point 42 lying on the antenna axis 36.

The antenna 32 is supported by an elevational gimbal support 44. The elevational gimbal support 44, which may be of conventional design, is operable to elevate the antenna 32 over a range of 90 degrees about an elevational axis 45, termed an elevational component of rotation. The rotational gimbal support 102 rotates the antenna 32, preferably by 360 degrees, about the system azimuth axis 30, termed an azimuthal component of rotation. The elevational gimbal support 44 and the rotational gimbal support 102 together constitute the gimbal support. In the typical case, the two rotational components provided by the gimbal supports 44 and 102 permit the aiming of the antenna in any direction on a hemispherical surface. The elevational gimbal support 44 permits the antenna to rotate about the axis 45. In one such rotational orientation, the antenna axis 36 is collinear with the system azimuth axis 30, the orientation shown in FIG. 1. The antenna axis 36 may also be rotated to orientations where it is not collinear with the system azimuth axis 30.

A mirror system 46 includes a number of mirrors that direct the beam from the beam source 22 to the antenna 32. The mirrors are structured to reflect the radiation of interest with low loss. For a microwave wave beam, the mirrors are preferably made of a metal such as aluminum or a metallized composite material.

A first paraboloid mirror 48 lies on the system azimuth axis 30 and is positioned to receive a beam 50 from the source 22. (The beam 50 is shown in FIG. 1 as a dashed-line set of ray paths originating at the source, reflecting from the series of mirrors, reflecting from the components of the antenna, and emanating outwardly from the antenna.) The first paraboloid mirror 48 is preferably located between the source 22 and the virtual focal point 42, as measured when the system azimuth axis 30 and the antenna axis 36 are collinear. The first paraboloid mirror 48 has an axis of symmetry 52 that is oriented at an angle A to the system azimuth axis 30. Angle A is 2 arctan (1/M), where M is the beam magnification and is 1.0 when there is no magnification. When A is set to this value, the beam waveguide system maintains the feed pattern symmetry and polarization purity.

A first planar mirror 54 lies off the system azimuth axis 30 and is positioned to receive the beam 50 from the first paraboloid mirror 48. The first planar mirror 54 preferably is positioned further from the virtual focal point 42 than the first paraboloid mirror 48, measured when the system azimuth axis 30 and the antenna axis 36 are collinear. The distance measurement is made along the system azimuth axis 30, to the first paraboloid mirror 48 and to the projection of the position of the first planar mirror 54 onto the system azimuth axis 30.

The first planar mirror 54 reflects the beam 50 in a direction generally parallel to but laterally displaced from the system azimuth axis 30. However, the direction of the reflected beam from the first planar mirror 54 may be controlled by tilting the first planar mirror 54. A first tilt drive 56 is operable to tilt the first planar mirror 54 about a first tilt axis 58 lying perpendicular to, but laterally displaced from, the system azimuth axis 30 and also perpendicular to the elevational axis 45. A second tilt drive 60 is operable to tilt the first planar mirror 54 about a second tilt axis 62 which is not parallel to the system azimuth axis 30, the elevational axis 45, or the first tilt axis 58. The tilting about the first tilt axis 58 and the second tilt axis 62 permits the direction of the beam emanating from the antenna 32 to be varied by a small amount without moving the antenna 32 in the elevational gimbal support 44, thereby providing a fine adjustment for the emanated beam direction which is accomplished by movements of a low-mass system component, the first planar mirror 54.

A second paraboloid mirror 64 lies off the system azimuth axis 30 and is positioned to receive the beam 50 from the first planar mirror 54. The first paraboloid mirror 48 and the second paraboloid mirror 64 cooperate to focus the beam 50 to the virtual focal point 42 of the antenna 32. In effect, the source 22 is imaged at the virtual focal point 42. Consequently, the size of the image of the source 22 at the virtual focal point 42 may be changed by using a second paraboloid mirror 64 of different focal length than the first paraboloid mirror 48. Preferably, the size of the source 22 is enlarged or magnified at the virtual focal point 42, so that a smaller, lighter actual source 22 may be used. The value of the focal length $F_2$ of the second paraboloid mirror 64 is $(M^2+1)/2M$ times focal length F1 of the first paraboloid mirror 48, where M is the preselected magnification factor.

A second planar mirror 66 lies on the system azimuth axis 30 and is positioned to receive the beam 50 from the second paraboloid mirror 64. The second planar mirror 66 is tiltable about the elevational axis 45 as the antenna is gimbaled. The second planar mirror 66 is aligned such that it reflects the beam 50 so as to be collinear with the antenna axis 36.

After reflection from the second planar mirror 66, the beam 50 passes through an aperture 70 in the main reflector 34, reflects from the subreflector 40, reflects from the main reflector 34, and is directed into free space.

To change the angle of elevation of the beam projected from the main reflector 34, the antenna 32 is rotated about the elevational axis 45 on the elevational gimbal support 44, also rotating the second planar mirror 66. The rotation of the second planar mirror 66 directs the beam 50 reflected from the second planar mirror 66 so as to always lie on the antenna axis 36 and thence be properly aimed to reflect from the subreflector 40.

To change the azimuthal angle, the antenna 32 and the components falling within the box 100 are rotated about the system azimuth axis 30 by the movement of the rotational gimbal support 102. The beam source 22 remains stationary. The support structure need not be designed to support its mass.

Figure 2:
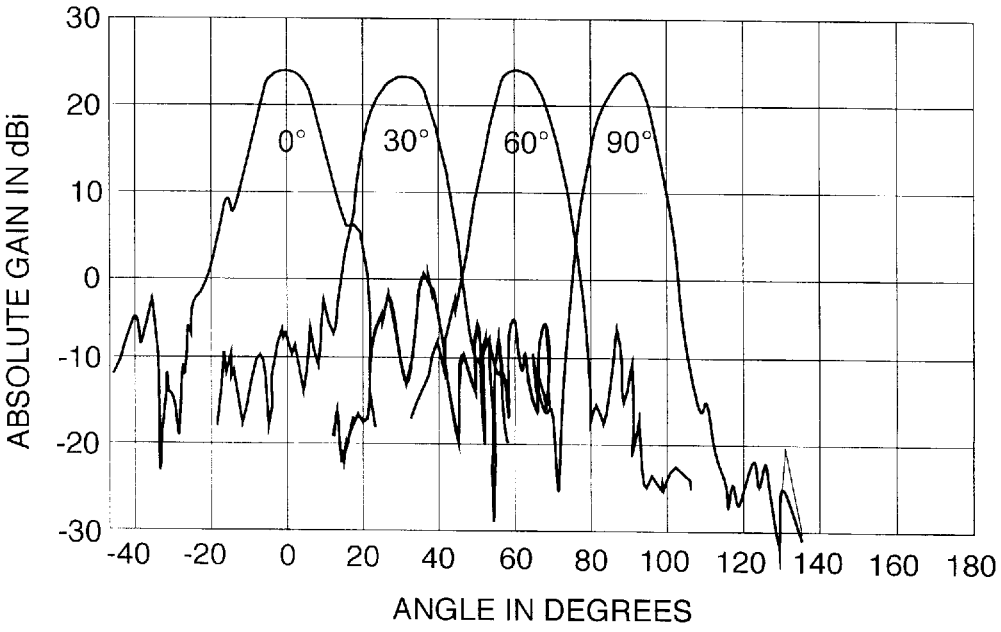
FIG. 2 is a graph of measured beam pattern for four elevations of the magnified feed horn through the beam waveguide system.

A prototype of the antenna system 20 has been built with a source magnification of 2.07. The prototype was operated with the source 22 having outputs at 75 GHz, 94 GHz, and 110 GHz. Test data was taken for azimuthal angles of 0, 90, 180, and 270 degrees, and for elevational angles of 0, 30, 45, 60, and 90 degrees. FIG. 2 presents a representative angular output distribution at 94 GHz of the antenna at 0 degrees azimuthal angle and elevational angles of 0, 30, 60, and 90 degrees. The outputs are quite similar at each of the elevational angles, an advantage of the invention.

The polarization purity of the approach of the invention was determined by measuring the cross-polarization of the feed magnified by a factor M of 2.07. The cross-polarization was measured to be −25 dB below the co-polarization peak. This was also predicted using a physical optics analysis code to be −25 dB. The same physical optics analysis code was used to predict the cross-polarization of the prior art antenna illustrated in FIG. 3 and discussed below with the same magnification factor M of 2.07. The predicted cross-polarization for this prior case was only −20 dB down from the co-polarization peak. Thus, for only a moderate magnification, the approach of the invention improved the polarization purity by 5 dB.

Figure 3:
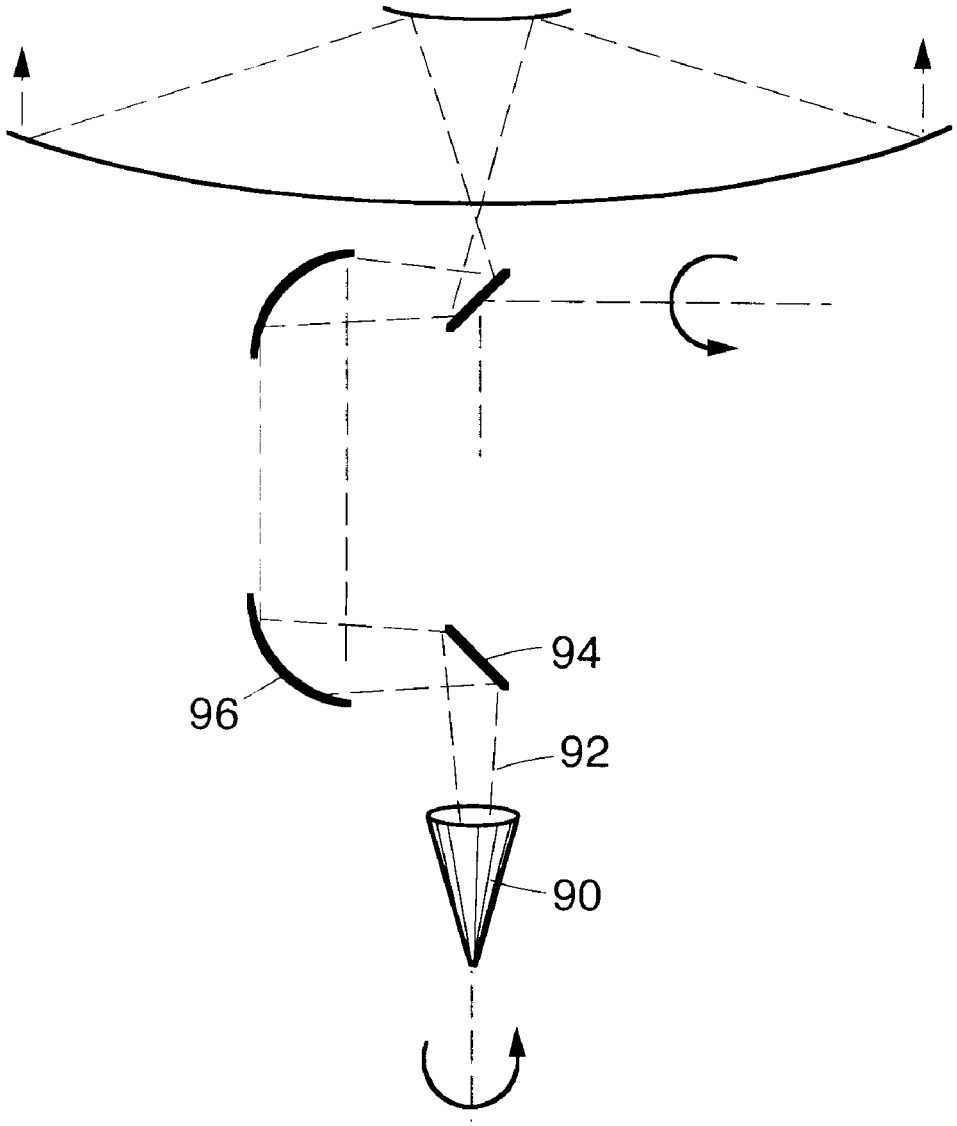
FIG. 3. ( PRIOR ART )
FIG. 3 is a schematic drawing of a prior antenna system using a prior beam waveguide.

FIG. 3 depicts a prior art approach to supplying a beam to an antenna. A source 90 directs a beam 92 to a first flat mirror 94, which reflects the beam to a first paraboloid mirror 96. This arrangement is different from the present approach of FIG. 1 in several respects. In the present approach the source 22 directs the beam 50 first to the first paraboloid mirror 48 and then to the first planar mirror 54, the inverse of the approach of FIG. 3. This rearrangement of elements has a number of surprising and unexpected results and advantages. First, with the approach of FIG. 3, there are significant spillover losses at the first flat mirror 94 when multiple feed horns are used, which are largely avoided in the present approach of FIG. 1. Second, the tilting of the first paraboloid mirror 48 by angle A in the approach of FIG. 1 maintains the symmetry of the beam 50, an important consideration in some applications. Third, the first planar mirror 54 of the approach of FIG. 1 may be tilted by small amounts about the tilt axes 58 and 62 to provide a fine adjustment to the beam steering with a low-mass, quickly adjusted structure, the mirror 54, rather than moving the much higher mass antenna 32. Fourth, the two paraboloid mirrors 48 and 64 may be made of different focal lengths to provide a magnification or reduction in the image of the source 22. If such magnification is attempted with the approach of FIG. 3, the symmetry of the beam is corrupted, a major drawback in some applications.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An antenna system, comprising:

a beam source of a beam of radiation, the beam source lying on and directed parallel to a system azimuth axis;

an antenna having an antenna axis and a focal point;

a mirror system operable to direct the beam from the beam source to the antenna, the mirror system comprising mirrors operable to reflect the beam and including:

a first paraboloid mirror lying on the system azimuth axis and positioned to receive the beam from the beam source, a first planar mirror lying off the system azimuth axis and positioned to receive the beam from the first paraboloid mirror, a second paraboloid mirror lying off the system azimuth axis and positioned to receive the beam from the first planar mirror, the first paraboloid mirror and the second paraboloid mirror cooperating to focus the beam to the focal point of the antenna, wherein a focal length of the second paraboloid mirror is approximately $(M^2+1)/2M$ times the focal length of the first paraboloid mirror, where M is a preselected magnification factor, and a a second planar mirror lying on the system azimuth axis and positioned to receive the beam from the second paraboloid mirror, the second planar mirror reflecting the beam collinear with the antenna axis; and a gimbal support for the antenna and for the mirror system, the gimbal support being operable to rotate the antenna and the mirror system about the system azimuth axis and to rotate at least some components of the antenna and the mirror system about an elevational axis lying perpendicular to the system azimuth axis.

2. The antenna system of claim 1, wherein the antenna comprises:

a Cassegrain main reflector having a focal point lying on an antenna axis, and a Cassegrain subreflector lying on the antenna axis at a location between the Cassegrain main reflector and the focal point of the Cassegrain main reflector, the Cassegrain subreflector having a virtual focal point lying on the antenna axis.

3. The antenna system of claim 1, wherein the beam source is a beam source of microwave signals.

4. The antenna system of claim 1, further including a first tilt drive operable to tilt the first planar mirror about a first tilt axis lying perpendicular to the system azimuth axis and also perpendicular to the elevational axis, and a second tilt drive operable to tilt the first planar mirror about a second tilt axis which is not parallel to the system azimuth axis, the elevational axis, or the first tilt axis.

5. The antenna system of claim 1, wherein a focal length of the second paraboloid mirror is different from a focal length of the first paraboloid mirror.

6. The antenna system of claim 1, wherein the beam source produces the microwave beam having a frequency of from about 1 GHz to about 200 GHz.

7. The antenna system of claim 1, wherein the first paraboloid mirror is located between the beam source and the focal point of the antenna, and wherein an axis of symmetry of the first paraboloid mirror is oriented at an angle of about 2 arctan(1/M) to the system azimuth axis.

8. An antenna system, comprising:

a beam source of a microwave beam, the beam source lying on and directed parallel to a system azimuth axis, the beam source comprising:

a microwave feed horn, and a transmitting tube that supplies a feed signal to the microwave feed horn;

an antenna comprising:

a Cassegrain main reflector having a focal point lying on an antenna axis, and a Cassegrain subreflector lying on the antenna axis at a location between the Cassegrain main reflector and the focal point of the Cassegrain main reflector, the Cassegrain subreflector having a virtual focal point lying on the antenna axis;

a mirror system operable to direct the microwave beam from the beam source to the antenna, the mirror system comprising mirrors operable to reflect the microwave beam and including:

a first paraboloid mirror lying on the system azimuth axis and positioned to receive the microwave beam from the microwave beam source, wherein the first paraboloid mirror is located between the microwave beam source and the virtual focal point of the antenna and wherein an axis of symmetry of the first paraboloid mirror is oriented at an angle of about 2 arctan(1/M) to the system azimuth axis, where M is a preselected magnification factor, a first planar mirror lying off the system azimuth axis and positioned to receive the microwave beam from the first paraboloid mirror, the first planar mirror being located further from the virtual focal point of the antenna than the first paraboloid mirror, a second paraboloid mirror lying off the system azimuth axis and positioned to receive the microwave beam from the first planar mirror, the first paraboloid mirror and the second paraboloid mirror cooperating to focus the microwave beam to the virtual focal point of the antenna, and a second planar mirror lying on the system azimuth axis and positioned to receive the microwave beam from the second paraboloid mirror, the second planar mirror reflecting the microwave beam collinear with the antenna axis and toward the Cassegrain subreflector through an aperture in the Cassegrain main reflector; and a gimbal support for the antenna and the mirror system, the gimbal support being operable to rotate the antenna and the mirror system about the system azimuth axis and at least some components of the antenna and the mirror system about an elevational axis lying perpendicular to the system azimuth axis.

9. The antenna system of claim 8, further including a first tilt drive operable to tilt the first planar mirror about a first tilt axis lying perpendicular to the antenna axis and also perpendicular to the elevational axis, and a second tilt drive operable to tilt the first planar mirror about a second tilt axis which is not parallel to the antenna axis, the elevational axis, or the first tilt axis.

10. The antenna system of claim 8, wherein the beam source produces the microwave beam having a frequency of from about 1 GHz to about 200 GHz.

11. The antenna system of claim 8, wherein a focal length of the second paraboloid mirror is different from a focal length of the first paraboloid mirror.

12. An antenna system, comprising:

a monopulse beam source of a microwave wave beam, the monopulse beam source lying on and directed parallel to a system azimuth axis;

an antenna comprising:

a Cassegrain main reflector having a focal point lying on an antenna axis, and a Cassegrain subreflector lying on the antenna axis at a location between the Cassegrain main reflector and the focal point of the Cassegrain main reflector, the Cassegrain subreflector having a virtual focal point lying on the antenna axis;

a gimbal support for the antenna, the gimbal support being operable to rotate the antenna about the system azimuth axis and about an elevational axis lying perpendicular to the system azimuth axis; and a mirror system operable to direct the microwave wave beam from the monopulse beam source to the antenna, the mirror system comprising mirrors operable to reflect the microwave wave beam and including:

a first paraboloid mirror lying on the system azimuth axis and positioned to receive the microwave wave beam from the monopulse beam source, a first planar mirror lying off the system azimuth axis and positioned to receive the microwave wave beam from the first paraboloid mirror, a second paraboloid mirror lying off the system azimuth axis and positioned to receive the microwave wave beam from the first planar mirror, the first paraboloid mirror and the second paraboloid mirror cooperating to focus the microwave wave beam to the virtual focal point of the antenna, wherein a focal length of the second paraboloid mirror is different from a focal length of the first paraboloid mirror, and a second planar mirror lying on the system azimuth axis and positioned to receive the microwave wave beam from the second paraboloid mirror, the second planar mirror reflecting the microwave wave beam collinear with the antenna axis and toward the Cassegrain subreflector through an aperture in the Cassegrain main reflector.

13. The antenna system of claim 12, wherein the monopulse beam source comprises at least two monopulse feed horns.

14. The antenna system of claim 12, wherein the first paraboloid mirror is located between the monopulse beam source and the virtual focal point of the antenna.

15. The antenna system of claim 12, wherein the first planar mirror is located at a position which, when projected onto the system azimuth axis, is such that the first paraboloid mirror is between the projected position and the virtual focal point of the antenna.

16. The antenna system of claim 12, further including a first tilt drive operable to tilt the first planar mirror about a first tilt axis lying perpendicular to the system azimuth axis and also perpendicular to the elevational axis, and a second tilt drive operable to tilt the first planar mirror about a second tilt axis which is not parallel to the system azimuth axis, the elevational axis, or the first tilt axis.

17. The antenna system of claim 12, wherein the monopulse beam source of produces the microwave wave beam having a frequency of from about 1 GHz to about 200 GHz.

18. An antenna system, comprising:

a beam source of a beam of radiation, the beam source lying on and directed parallel to a system azimuth axis;

an antenna having an antenna axis and a focal point;

a mirror system operable to direct the beam from the beam source to the antenna, the mirror system comprising mirrors operable to reflect the beam and including:

a first paraboloid mirror lying on the system azimuth axis and positioned to receive the beam from the beam source, a first planar mirror lying off the system azimuth axis and positioned to receive the beam from the first paraboloid mirror, a second paraboloid mirror lying off the system azimuth axis and positioned to receive the beam from the first planar mirror, the first paraboloid mirror and the second paraboloid mirror cooperating to focus the beam to the focal point of the antenna, wherein a focal length of the second paraboloid mirror is different from a focal length of the first paraboloid mirror, and a second planar mirror lying on the system azimuth axis and positioned to receive the beam from the second paraboloid mirror, the second planar mirror reflecting the beam collinear with the antenna axis; and a gimbal support for the antenna and for the mirror system, the gimbal support being operable to rotate the antenna and the mirror system about the system azimuth axis and to rotate at least some components of the antenna and the mirror system about an elevational axis lying perpendicular to the system azimuth axis.

19. The antenna system of claim 18, wherein the antenna comprises:

a Cassegrain main reflector having a focal point lying on an antenna axis, and a Cassegrain subreflector lying on the antenna axis at a location between the Cassegrain main reflector and the focal point of the Cassegrain main reflector, the Cassegrain subreflector having a virtual focal point lying on the antenna axis.

20. The antenna system of claim 18, wherein the beam source is a beam source of microwave signals.

21. The antenna system of claim 18, further including a first tilt drive operable to tilt the first planar mirror about a first tilt axis lying perpendicular to the system azimuth axis and also perpendicular to the elevational axis, and a second tilt drive operable to tilt the first planar mirror about a second tilt axis which is not parallel to the system azimuth axis, the elevational axis, or the first tilt axis.

22. The antenna system of claim 18, wherein the beam source produces the microwave beam having a frequency of from about 1 GHz to about 200 GHz.

23. The antenna system of claim 18, wherein the first paraboloid mirror is located between the beam source and the focal point of the antenna, and wherein an axis of symmetry of the first paraboloid mirror is oriented at an angle of about 2 arctan(1/M) to the system azimuth axis, where M is a preselected magnification factor.

* * * * *